United States Patent [19]

Shive, Jr.

[11] 4,364,494

[45] Dec. 21, 1982

[54] SMOCK GATHERING APPARATUS

[75] Inventor: Stewart S. Shive, Jr., New Haven, Ind.

[73] Assignee: Janice R. Filbert, New Haven, Ind.

[21] Appl. No.: 208,196

[22] Filed: Nov. 19, 1980

[51] Int. Cl.[3] ..... A44C 5/00; B62J 7/00

[52] U.S. Cl. ..... 223/28; 223/32

[58] Field of Search ..... 223/28, 32, 33

[56] References Cited

U.S. PATENT DOCUMENTS

| | | | |
|---|---|---|---|
| 2,141,235 | 12/1938 | Angeletti | 223/32 X |
| 2,551,808 | 5/1951 | Minns | 223/32 |
| 2,774,525 | 12/1956 | Angevine | 223/32 |

FOREIGN PATENT DOCUMENTS

| | | | |
|---|---|---|---|
| 137172 | 5/1950 | Australia . | |
| 960367 | 4/1950 | France . | |
| 450913 | 8/1949 | Italy . | |
| 275144 | 5/1951 | Switzerland . | |
| 643093 | 9/1950 | United Kingdom | 223/32 |

*Primary Examiner*—Louis Rimrodt

*Attorney, Agent, or Firm*—Gust, Irish, Jeffers & Hoffman

[57] ABSTRACT

A smock gathering apparatus includes a base board having two spaced apart bearing blocks mounted thereon. A shaft adapted to support a roll of cloth material to be gathered is mounted for rotation in bearing apertures in the bearing blocks. The blocks are adjustably secured on the base board and means are provided for removably securing a smock gathering machine on the base board between the two bearing blocks and in operative relation to the shaft.

11 Claims, 8 Drawing Figures

SMOCK GATHERING APPARATUS

BACKGROUND OF THE INVENTION

1. Field of the Invention

The present invention relates to specialty sewing apparatus and more particularly to a gathering apparatus useful in smocking.

2. Description of the Prior Art

Smock gathering machines are well know, typical of these being a machine known by the trademark "THE READ" and otherwise as disclosed in British Pat. No. 643,093, granted on Sept. 15, 1950. This machine is manually operated and includes a series of fluted, gathering rollers in operative engagement and provided with a series of axially spaced annular grooves for receiving smocking needles. The rollers are mounted on fixed end plates provided with apertures for receiving a dowel rod on which is wound the cloth to be gathered. In use, the dowel rod is manually positioned such that the cloth wrapped thereon can be threaded between the rollers which forms the cloth into pleats or gathers and impales them onto the gathering needles. The cloth is eased off of the needle shanks onto the threads connected thereto until the desired length of cloth has been gathered. By tying knots in the opposite ends of the threads, the material may be retained in its gathered condition. Further prior art is found in the following patents, South Africa No. 277/47; French No. 960:367; Italian No. 450:913; British No. 643,093; Australian No. 137:172; Swiss No. 275,144; Eire Pat. No. 18453; Pakistan No. 102,725; and India No. 44,923.

SUMMARY OF THE INVENTION

Smock gathering apparatus includes a base board having two spaced apart bearing blocks mounted thereon. A shaft adapted to support a roll of cloth material to be gathered is mounted for rotation in bearing apertures in such bearing blocks. The blocks are adjustably secured onto the base board for movement toward and away from each other. Means are provided on the base board for removably securing a smock gathering machine thereto between the bearing blocks in operative relation to the shaft.

It is an object of this invention to provide an apparatus useful in conjunction with a smock gathering machine for gathering cloth material in a facile, uniform manner.

It is another object of this invention to provide an apparatus for gathering cloth material wherein the various components thereof are firmly held in proper position so that the gathering process may be performed quickly, uniformly and with ease.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
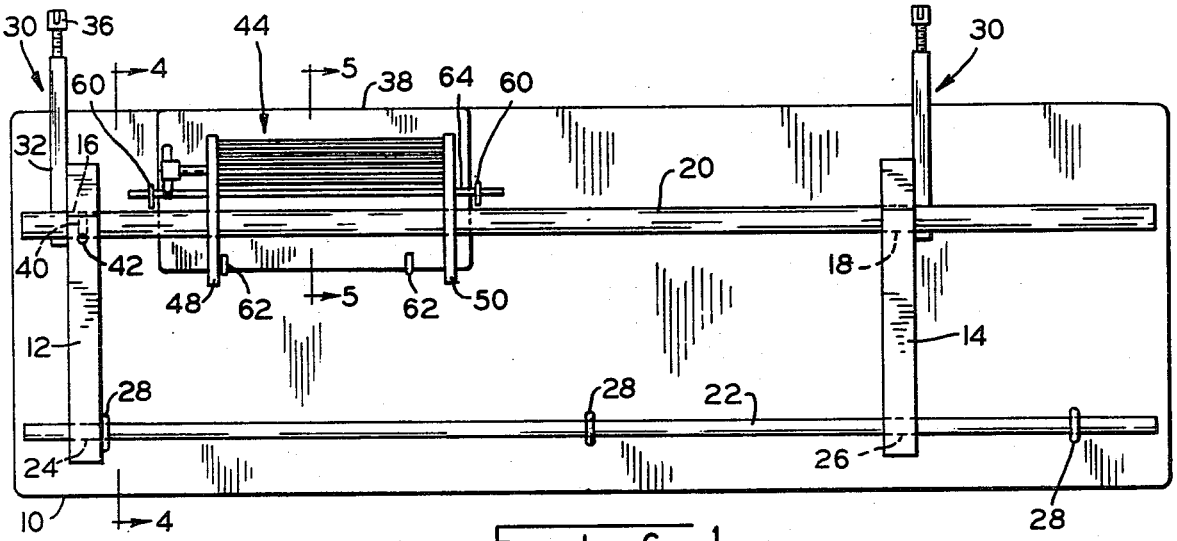
FIG. 1 is a top plan view of an embodiment of this invention.
Figure 2:
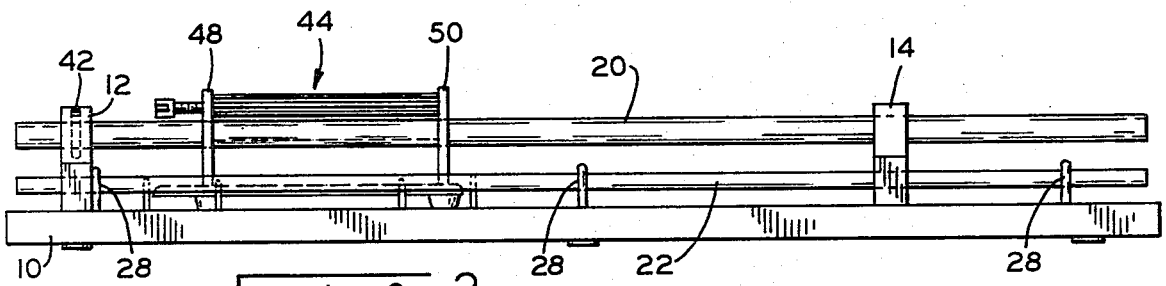
FIG. 2 is a rear view thereof.

Referring to the drawings, a flat base 10 of wood or other suitable material has disposed on the upper surface thereof two elongated bearing blocks 12 and 14 also preferably made of wood. These two blocks 12 and 14 are suitably spaced apart and arranged in parallelism with bearing apertures 16 and 18 therein receiving for rotation a dowel rod or shaft 20 also preferably of wood. A rod 22 spaced above but secured to the base 10 is used for securing the rear ends of the bearing blocks 12 and 14 to the board, these bearing blocks having clearance apertures 24 and 26, respectively, for slidably receiving the rod 22. The rod 22 is secured to the base board 10 by means of threaded fasteners in the form of eyelets 28 spaced apart and screwed into the base board 10. The rod 22 is received by the eyelets 28 thereby securing the rod 22 and the bearing blocks to the base board 10.

For further securing the bearing blocks 12 and 14 in place, adjustable clamping devices indicated generally by the reference numeral 30 are provided. Each clamping device 30 includes an elongated shank which may be in the form of an angle iron secured by some suitable means such as threaded fasteners to the respective bearing block 12, 14, this shank 32 extending parallel to the upper surface of the base board 10 as shown. The outer end of the shank 32 is bent downwardly to form a flange portion 34 which has threaded therethrough a clamping screw 36 adapted to engage the front edge 38 of the base board 10 as shown. By tightening the screw 36, the respective bearing block 12, 14 is placed in tension against the holding force of the connection with the mounting rod 22. The frictional grip of the screw 36 is adequate to prevent inadvertent movement of the bearing block. If it should be desired to move either or both of the bearing blocks relative to the mounting rod 22 and base board 10, it is only necessary to loosen the adjusting screw 36, slide the bearing block sideways and then retighten the screw.

In order to prevent endwise movement of the shafts 20 relative to the bearing blocks 12 and 14, that portion of the shaft 20 within bearing aperture 16 is provided with an annular groove 40. A retaining pin 42 fitting into said groove is disposed within a companion socket in the bearing block 12 which is in registry with the groove 40 such that the shaft 20 may be rotated but is held against endwise movement.

Figure 3:
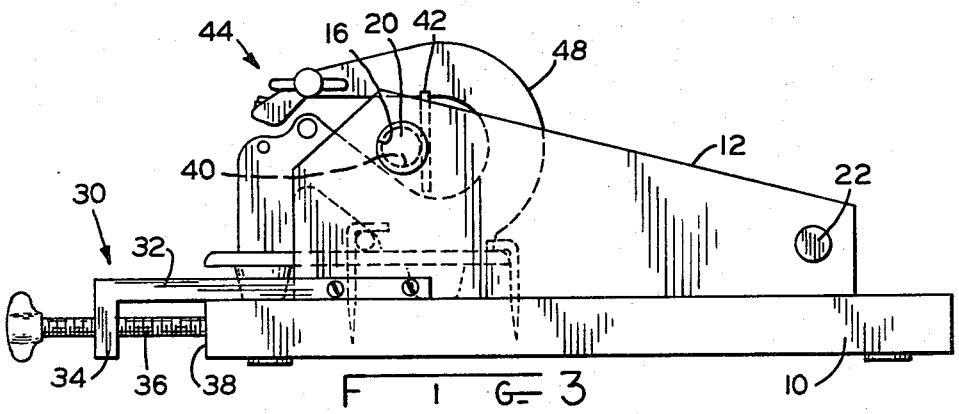
FIG. 3 is an end view.
Figure 4:
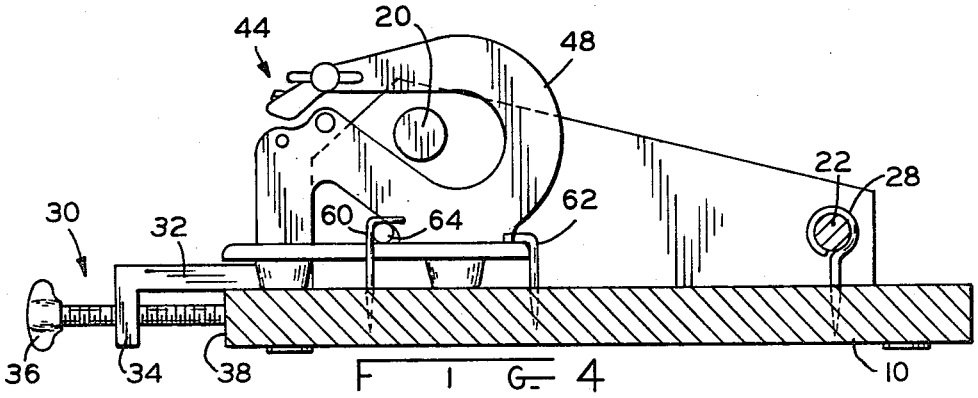
FIG. 4 is a cross section taken substantially along section line 4—4 of FIG. 1.

As shown in FIGS. 1 and 3, the shaft 20 is disposed intermediate the opposite ends of the respective bearing blocks 12 and 14. Between these bearing blocks is disposed a smock gathering machine indicated generally by the reference numeral 44. As shown more clearly in FIGS. 4 and 5, this machine 44 essentially like that disclosed in South African Pat. No. 643,093, granted Sept. 15, 1950, which is conventional in the art, and otherwise known by the trademark "READ," includes a flat base 46 having upstanding, apertured end plates 48 and 50 secured thereto. Fluted, gathering rollers 52, 54, 56 and 57 are journalled in the end plates in such positions as to be properly meshed. A plurality of S-curved gathering needles 58 are suitably held in position in relation to axially spaced, annular grooves in such rollers.

This machine 44 is removably secured to the upper surface of the base board 10 by means of two pairs of suitable pins, these being indicated by the numerals 60 and 62. These pins are in the form of screws which may be threaded into the base board 10. The upper ends are bent over at right angles as shown, with the bent ends of the pins 62 slidably engaging the upper surface of the rear edge portion of the flat machine base 46. The bent ends on the two pins 60 are disposed slightly higher than those of the pin 62 so as to fit over and engage a dowel rod 64 which rests on the upper surface of the machine base 46, this resulting in clamping or holding firmly the machine base 46 onto the upper surface of the base board 10.

Figure 5:
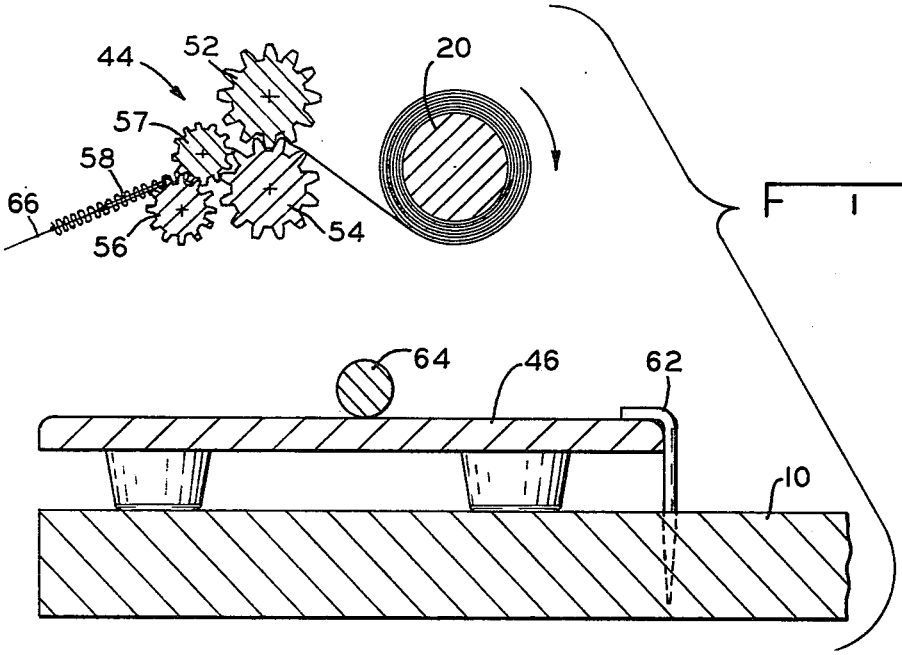
FIG. 5 is a cross section more particularly of the smock gathering machine taken substantially along section line 5—5 of FIG. 1.
Figure 7:
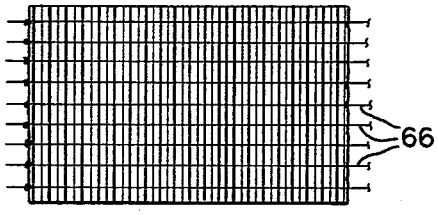
FIG. 7 is a top view of a length of the same gathered material.
Figure 6:
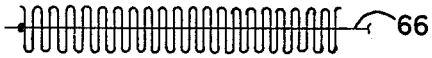
FIG. 6 is an edge view of a piece of cloth material that has been gathered.

The machine 44 is so positioned on the base board that the cloth-bearing shaft 20 is received by the clearance openings in the end plates 48 and disposed in operative relation with the machine rollers 52 and 54 (see FIG. 5). In use, the end edge of the cloth on the shaft 20 is threaded between the rollers 52 and 54. Rotation of these fluted rollers draws the cloth therebetween and by reason of the flutes to form the cloth into pleats or gathers, these being impaled onto the various needles 58. By manually easing the material off the shanks of the needles onto the threads attached thereto, continued rotation of the rollers serves in producing more pleats thereby resulting in the cloth being gathered as shown in FIG. 6. The pleats are shown in undulated form with the threads 66 passing through the central portion thereof holding the pleats in place.

This invention facilitates the use of the gathering machine 44. Conventionally, this machine 44 has been used by placing it on a flat surface, such as the floor, with the user sitting on the floor straddling the machine. A dowel rod, such as shaft 20, is passed through the end plates 48 of the machine and the cloth wrapped thereon is threaded between the rollers as explained above. With one hand, the rollers 52, etc., are rotated and with the other hand, the dowel rod 20 is held and permitted to rotate as material is fed between the rollers. As will be obvious, it is not possible to hold the dowel rod steady enough such that both angular and endwise movement results producing a non-uniform gathering of the cloth material. In order to produce a good quality gathering using this technique, considerable skill is required.

By using the present invention, the shaft 20 is positively held in position such that operation of the machine 44 results in producing uniform gathering of good quality. If it is desired to gather a piece of material in a width longer than the machine 44, it is only necessary to repeat the gathering steps described above in gathering adjacent sections. Since the shaft 20 is held against endwise movement, and the machine 44 is locked into position relative to the shaft 20, the material fed to the rollers in the machine will be maintained straight with the result that the gathering threads will also be straight. Gathering threads of adjacent sections are therefore truly parallel providing a gathering which is wider than the machine 44 itself.

The apparatus is the utmost in simplicity and may be easily assembled and disassembled. In order to disassemble, it is only necessary to slide the dowel rod 64 out from under the bent over portions of the two pins 60. The machine 44 may thereupon be withdrawn from beneath the bent over portions of the two pins 62 following removal of the shaft 20 from the bearing blocks 12 and 14. Removal of the shaft 20 is accomplished by first loosening the adjusting screws 36, withdrawing the pin 42 from the bearing block 12 and then merely withdrawing the shaft 20 from the two bearing blocks 12 and 14. The rod 22 may be merely withdrawn from the two bearing blocks 12 and 14 and the eyelets 28 thereby releasing the latter completely from the base board 10. Components may be thereby conveniently packaged for storage.

Figure 8:
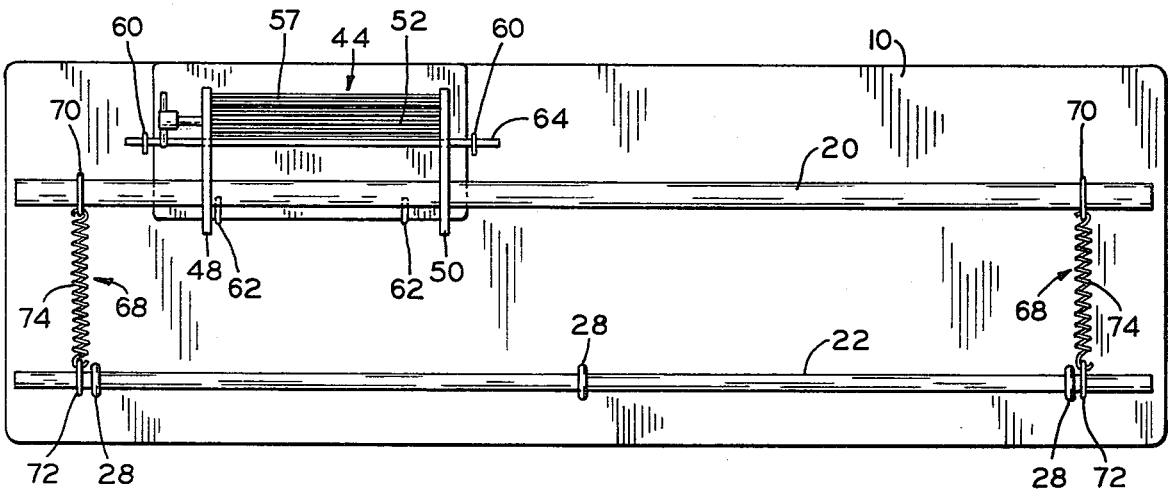
FIG. 8 is a top plan view of another embodiment of this invention.

Another embodiment of this invention is shown in FIG. 8. This embodiment is essentially the same as that disclosed in the preceding but differs primarily in the omission of the bearing blocks 12 and 14. Used in place of the bearing blocks are two tension spring devices indicated by the numeral 68, these including rings 70 telescoped over the shaft 20 as shown and other rings or hooks 72 fitted over the rod 22. Between the ring 70 and the hooks or rings 72 are stretched helical tension springs 74. The spring devices 68 are so located relative to the gathering machine 44 as to hold the shaft 20 against the rear portions of the openings in the machine end plates 48. The tension of the springs 74 provide some friction against rotation of the shaft 20. Operation of this embodiment is essentially the same as that described hereinabove. However, since there is no means for holding the shaft 20 against endwise movement, it is important that the operator, during manual rotation of the shaft 20, take care in not moving the shaft 20 endwise. This embodiment while not containing other desirable features of the preferred embodiment is less expensive and less complicated.

While there have been described above the principles of this invention in connection with specific apparatus, it is to be clearly understood that this description is made only by way of example and not as a limitation to the scope of the invention.

What is claimed is:

1. Apparatus of the character described comprising a base board, two spaced apart bearing blocks carried by said board, a shaft adapted to support a roll of cloth material to be gathered mounted for rotation in bearing apertures in said bearing blocks, first means for adjustably securing said blocks in position on said base board, second means on said base board for removably securing a smock gathering machine thereto between said bearing blocks and in operative relation to said shaft, said first securing means including a mounting rod secured to said base board in substantially parallel relation thereto and received by clearance openings in said bearing blocks whereby said bearing blocks may be adjusted toward and away from each other in parallelism with said shaft.

2. The apparatus of claim 1 wherein said first securing means further includes an adjustable clamping device connecting at least one of said bearing blocks to said base board.

3. The apparatus of claim 2 wherein said clamping device includes a bracket having an elongated shank portion secured to said one bearing block and extending beyond the front edge of said base board, a portion on the end of said shank portion juxtaposed with respect to said front edge, and a securing element threadedly received by said juxtaposed portion and extending substantially parallel to said base board for selective engagement with said front edge.

4. The apparatus of claim 3 wherein each bearing block is elongated with said shaft being journalled therein between the ends thereof, said mounting rod being connected to each bearing block near one end thereof and said clamping device being secured to the other end thereof whereby tightening of said securing element exerts a tension on the bearing block against the holding force of said mounting rod.

5. The apparatus of claim 4 wherein said shaft has an annular groove disposed within the bearing aperture of one of said blocks, a pin removably fitted into a retaining bore in said block in registry with said groove whereby said shaft is held against endwise movement but is capable of rotation in said bearing aperture.

6. The apparatus of claim 1 wherein said mounting rod is secured to said base board by means of threaded fasteners having eyelets, said mounting rod being received by said eyelets and said fasteners having shanks connected to said base board, and said removably securing means including spaced apart upstanding pins on said base board, a first set of two pins being spaced in a direction parallel to said shaft, a second set of two pins also being spaced parallel to said shaft, said first and second sets further being spaced transversely of said shaft and having end portions bent inwardly toward each other thereby defining captive spaces between such end portions and said base board.

7. The apparatus of claim 6 wherein said removably securing means includes a bar received in the captive spaces of one of said sets in engagement with said end portions, said bar being adapted to lie flush on the top of the base of said smock gathering machine thereby clamping the latter to said base board.

8. The apparatus of claim 7 including a smock gathering machine having a flat base removably secured to said base board by means of said pin sets, and apertured end plates on said machine which receive said shaft therethrough.

9. Apparatus of the character described comprising a base board, a gathering machine removably secured to said base board, said gathering machine having two upstanding apertured end plates which are spaced apart and parallel, a shaft adapted to carry a roll of cloth therein in registry with said machine rotatably received by the apertures in said end plates, a holding rod extending parallel to said shaft secured to said board, said rod being disposed to the rear of said machine, two tension spring devices connected between said shaft and rod on opposite sides, respectively, of said machine, said spring devices holding said shaft against the rear portions of the apertures in said end plates.

10. The apparatus of claim 9 wherein said means includes two tension spring devices connected between said shaft and rod on opposite sides, respectively, of said machine, said spring devices holding said shaft against the rear portions of the apertures in said end plates.

11. The apparatus of claim 10 wherein each said spring device includes a helical tension spring having a ring on one end which slidably receives said shaft and a ring or hook on the opposite end which slidably receives said rod.

* * * * *

UNITED STATES PATENT AND TRADEMARK OFFICE

CERTIFICATE OF CORRECTION

PATENT NO. : 4,364,494

DATED : December 21, 1982

INVENTOR(S) : STEWART S. SHIVE, JR.

It is certified that error appears in the above—identified patent and that said Letters Patent is hereby corrected as shown below:

Col. 1, Line 9, change "know" to --known--.
Col. 2, Line 65, change "South African" to --British--.

Signed and Sealed this

*Twelfth* Day of *July 1983*

[SEAL]

*Attest:*

GERALD J. MOSSINGHOFF

*Attesting Officer*

*Commissioner of Patents and Trademarks*